US006674014B2

(12) United States Patent
Miller et al.

(10) Patent No.: US 6,674,014 B2
(45) Date of Patent: Jan. 6, 2004

(54) UNIQUE WAY OF TERMINATING DEVICES USING INSULATION DISPLACEMENT

(75) Inventors: James P. Miller, Waukesha, WI (US); Sal Eminovic, Racine, WI (US); Paul Gieschen, Mequon, WI (US); Darrell S. Filtz, Cedarburg, WI (US)

(73) Assignee: Rockwell Automation Technologies, Inc., Mayfield Heights, OH (US)

( * ) Notice: Subject to any disclaimer, the term of this patent is extended or adjusted under 35 U.S.C. 154(b) by 0 days.

(21) Appl. No.: 09/966,500

(22) Filed: Sep. 28, 2001

(65) Prior Publication Data

US 2003/0062191 A1 Apr. 3, 2003

(51) Int. Cl.[7] ..... H01B 17/12
(52) U.S. Cl. ..... 174/176; 439/418; 439/413
(58) Field of Search ..... 439/418, 413, 439/409, 389, 395, 396, 405, 439; 174/176

(56) References Cited

U.S. PATENT DOCUMENTS 4,171,857 A * 10/1979 Forberg et al. ..... 439/402
4,611,874 A * 9/1986 Gerke et al. ..... 439/404
4,615,576 A * 10/1986 Gerke et al. ..... 439/404
4,775,330 A * 10/1988 Teichler et al. ..... 439/395
5,549,483 A * 8/1996 Hotea ..... 439/399
5,591,045 A * 1/1997 Pepe et al. ..... 439/404
5,989,071 A * 11/1999 Larsen et al. ..... 439/418

* cited by examiner

*Primary Examiner*—Dean A. Reichard
*Assistant Examiner*—Jinhee Lee
(74) *Attorney, Agent, or Firm*—Tait R. Swanson; Alexander M. Gerasimow; William R. Walbrun

(57) ABSTRACT

The present technique provides a technique for electrically wiring devices using insulation displacement. The technique arranges a plurality of insulation displacement members in wedge-shaped configurations for piercing an insulation layer and electrically contacting a conductor of an insulated electrical wire assembly. The insulation displacement members may be disposed at any suitable angles and offsets to provide an effective multipoint electrical contact with the conductor. The insulated electrical wire assembly also may be carried by a wire support structure to facilitate insertion and removal of the insulated electrical wire assembly with the arrangement of insulation displacement members.

42 Claims, 5 Drawing Sheets

UNIQUE WAY OF TERMINATING DEVICES USING INSULATION DISPLACEMENT

BACKGROUND OF THE INVENTION

The present invention relates generally to the field of electronics, such as industrial automation, computing, network and communication devices. More particularly, the invention relates to a technique for electrically terminating devices using an assembly of wedge-shaped insulation displacement members, which are configured to pierce insulation and contact internal conductors.

Electrical devices are often inserted into electrical systems or networks in temporary or permanent configurations, which may require maintenance, replacement, swapping and other routine servicing. This routine servicing may require detachment and reattachment of the electrical device to the electrical system or network. Unfortunately, conventional wiring techniques typically involve fixed or single-use connection mechanisms, which are not particularly well suited for routine servicing or swapping of electrical devices within the electrical systems. For example, servicing or reconfiguration of the electrical system may require detachment and reattachment of a relay, a contactor, a push button, a terminal block or various other electrical devices.

Accordingly, there is a present need for an improved technique for wiring to electrical devices, such as relays, contactors, pushbuttons, and terminal blocks. There is a particular need for a quick and efficient wiring technique, which facilitates connectivity to a plurality of devices without rewiring of each device.

SUMMARY OF THE INVENTION

The present invention provides a novel technique for electrically wiring devices, such as industrial automation, computing, network and communication devices and various systems of such devices. The technique arranges a plurality of insulation displacement members in wedge-shaped configurations for piercing an insulation layer and electrically contacting a conductor of an insulated electrical wire assembly. The insulation displacement members may be disposed at any suitable angles and offsets to provide an effective multipoint electrical contact with the conductor. The insulated electrical wire assembly also may be carried by a wire support structure to facilitate insertion and removal of the insulated electrical wire assembly with the arrangement of insulation displacement members. The foregoing technique is applicable in a wide range of electronic devices and systems. However, it is particularly well suited for electronic devices requiring maintenance, servicing, replacement, swapping and other routine access or removal. For example, the present technique may be applied to components suitable in several applications or locations within a network.

In one aspect, the present technique provides an electrical connector comprising a first insulation displacement member disposed at a first angle and a second insulation displacement member disposed at a second angle. The first and second insulation displacement members also comprise conductive blades configured for contacting a conductor disposed in an insulative material.

In another aspect, the present technique provides an electrical wiring system. The system comprises a plurality of insulation displacement members disposed at desired angles for electrically contacting an insulated electrical wire assembly. An electrical connector is also coupled to the plurality of insulation displacement members for electrically coupling the insulated electrical wire assembly to a desired device.

In another aspect, the present technique provides a method of coupling an insulated electrical wire assembly to a desired device. The method comprises angularly piercing insulation of the insulated electrical wire assembly in a plurality of locations. The insulated electrically wire assembly is also electrically contacted in the plurality of locations.

In another aspect, the present technique provides a method of forming an electrical connector for coupling an insulated electrical wire assembly to a desired device. The method comprises providing a plurality of electrical connector members comprising wedge-shaped cutting members. The method also includes disposing the plurality of electrical connector members in desired angles relative to an axis extending through the wedge-shaped cutting members.

BRIEF DESCRIPTION OF THE DRAWINGS

The foregoing and other advantages of the invention will become apparent upon reading the following detailed description and upon reference to the drawings in which.

DETAILED DESCRIPTION OF SPECIFIC EMBODIMENTS

Figure 1:
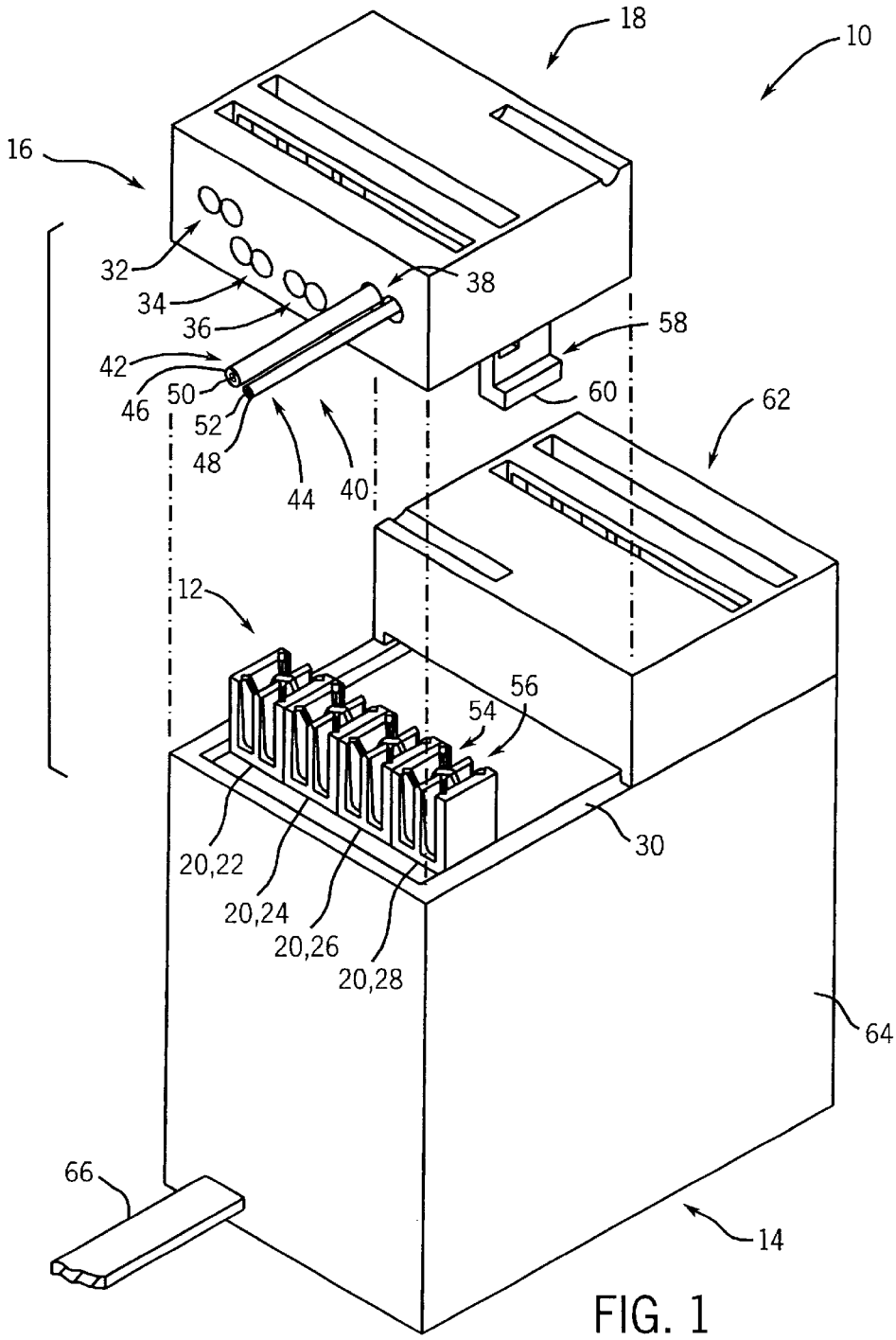
FIG. 1 is a perspective view of an exemplary wiring system of the present technique.

Turning now to the drawings, and referring first to FIG. 1, an electrical system is illustrated in accordance with the present technique and designated generally by reference numeral 10. The electrical system 10 may include a variety of insulated electrical wire assemblies and components, such as relays, contactors, pushbuttons, terminal blocks, circuits, and other desired electric, electronic and computing components. For example, the electrical system 10 may be incorporated into any desired electrical system or network, including networks of manufacturing and assembly devices, communication devices, electrical transmission and control devices, computing devices, any various other industrial devices. As illustrated, the electrical system 10 includes an electrical contact section 12 disposed on an electrical device 14, and a wire carrier section 16 disposed on an electrical device 18. These electrical contact and wire carrier sections 12 and 16 facilitate an efficient electrical contact between the electrical devices 14 and 18. Moreover, these sections 12 and 16 may be incorporated into one or more mobile or stationary devices, such as devices usable in mobile systems, devices swappable for multiple uses, devices removable or swappable with fixed devices, devices fixed in a network or electronic system, or any other suitable applications, as described above.

The electrical contact section 12 comprises one or more electrical contactors configured to pierce insulation of an insulated wire assembly and electrically contact a conductor disposed within the insulated wire assembly. For example, the electrical contact section 12 illustrated in FIG. 1 has an electrical contactor 20 disposed in locations 22, 24, 26 and 28 along a wiring side 30 of the electrical device 14. Each of these electrical contactors 20 is configured for electrically contacting one or more insulated wires carried by the wire carrier section 16 of the electrical device 18. For example, the wire carrier section 16 illustrated in FIG. 1 has receptacle sets 32, 34, 36 and 38 configured to support insulated wire sets for insertion into the electrical contactors 20 disposed in locations 22, 24, 26 and 28, respectively. These receptacle sets 32, 34, 36 and 38 may embody closed receptacles, open receptacles, closeable receptacles, or any other suitable wire support structure. Also note that the receptacle sets 32, 34, 36 and 38 are disposed in a staggered configuration to facilitate a smooth intercoupling of the insulated wires with the contactors 20 disposed in the electrical device 14. As the electrical devices 14 and 18 are interlocked, this staggered configuration reduces the overall force required to insert the insulated wires into the contactors 20. Accordingly, any suitable staggering may be used to reduce the insertion force of the insulated wires. As illustrated, the electrical device 18 has an insulated wire set 40 extending through the receptacle set 38. This insulated wire set 40, and any other insulated wire sets disposed in the receptacle sets 32, 34, 36 and 38, may embody any number, gauge, geometry, grouping or configuration of insulated wire assemblies. However, in this exemplary embodiment, the receptacle set 38 and the corresponding electrical contactor 20 are configured to support and contact insulated wire assemblies 42 and 44, which have insulation layers 46 and 48 disposed about conductors 50 and 52, respectively. Any suitable insulation and conductor material may be used within the scope of the present technique.

As the electrical device 18 is moved toward the wiring side 30, the insulated wire assemblies 42 and 44 are inserted into receptacles 54 and 56, where the electrical contactor 20 pierces the insulation layers 46 and 48 and electrically contacts the conductors 50 and 52, respectively. The electrical device 18 also has a connector assembly 58 for mechanically coupling the electrical device 18 to the electrical device 14 at the wiring side 30. In this exemplary embodiment, the connector assembly 58 comprises a pair of snap members 60 for tool-lessly coupling the electrical device 18 to the wiring side 30. The electrical device 14 also may have a plurality of the electrical contact sections 12, each of which is configured to receive insulated wire sets directly or carried by a wire carrier section. As illustrated, the electrical device 14 has an electrical device 62 coupled to the wiring side 30 adjacent the electrical contact section 12 for the electrical device 18. Accordingly, the electrical device 14 may have one or more separate or integrated electrical or electronic components disposed within its housing 64, as discussed above. The electrical device 14 also may have an insulated wire assembly 66 for coupling the electrical device 14 to a desired electric, electronic or computing system or network.

Figure 2:
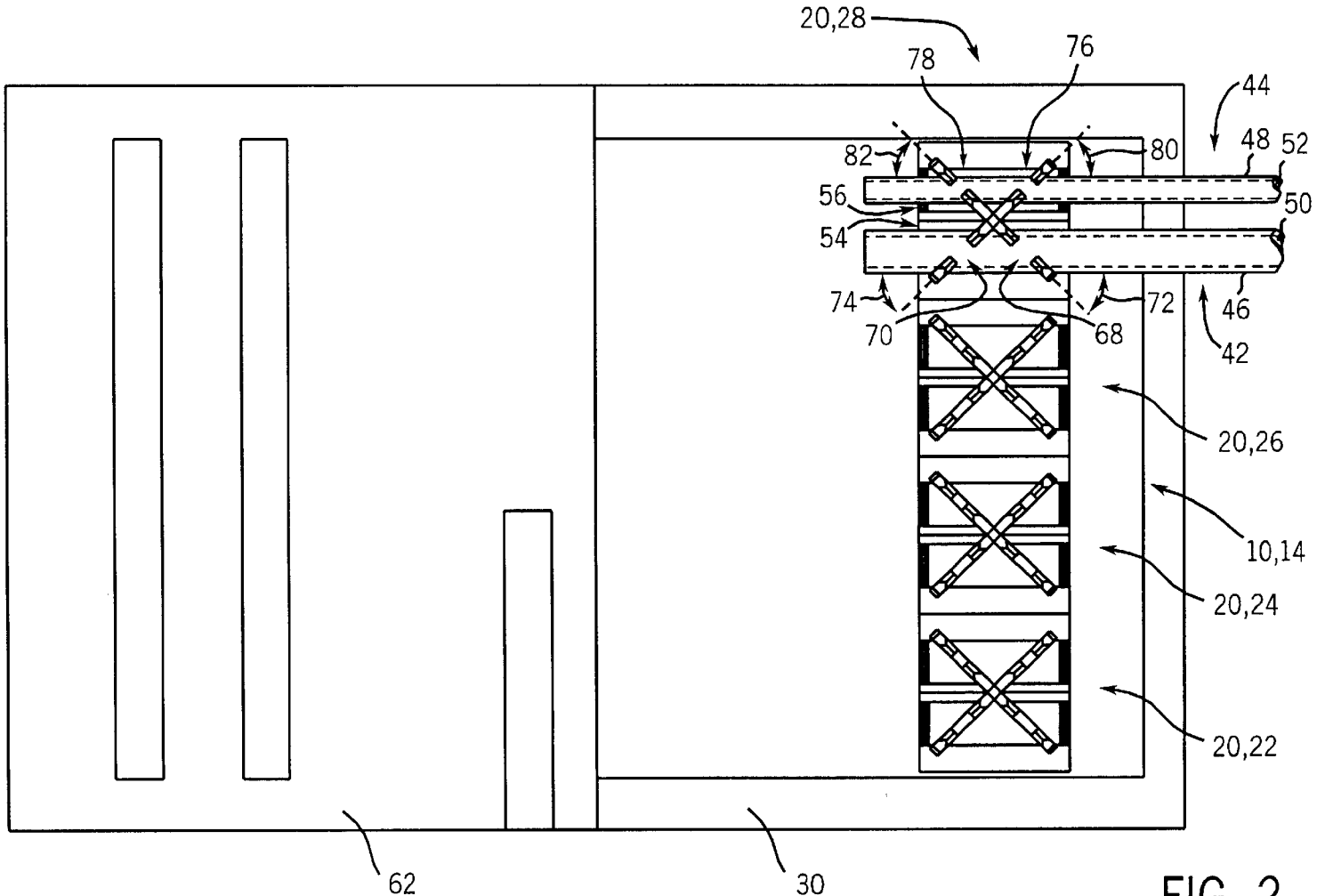
FIG. 2 is a top view of the wiring system illustrating connectivity of wires with an exemplary electrical contactor.
Figure 3:
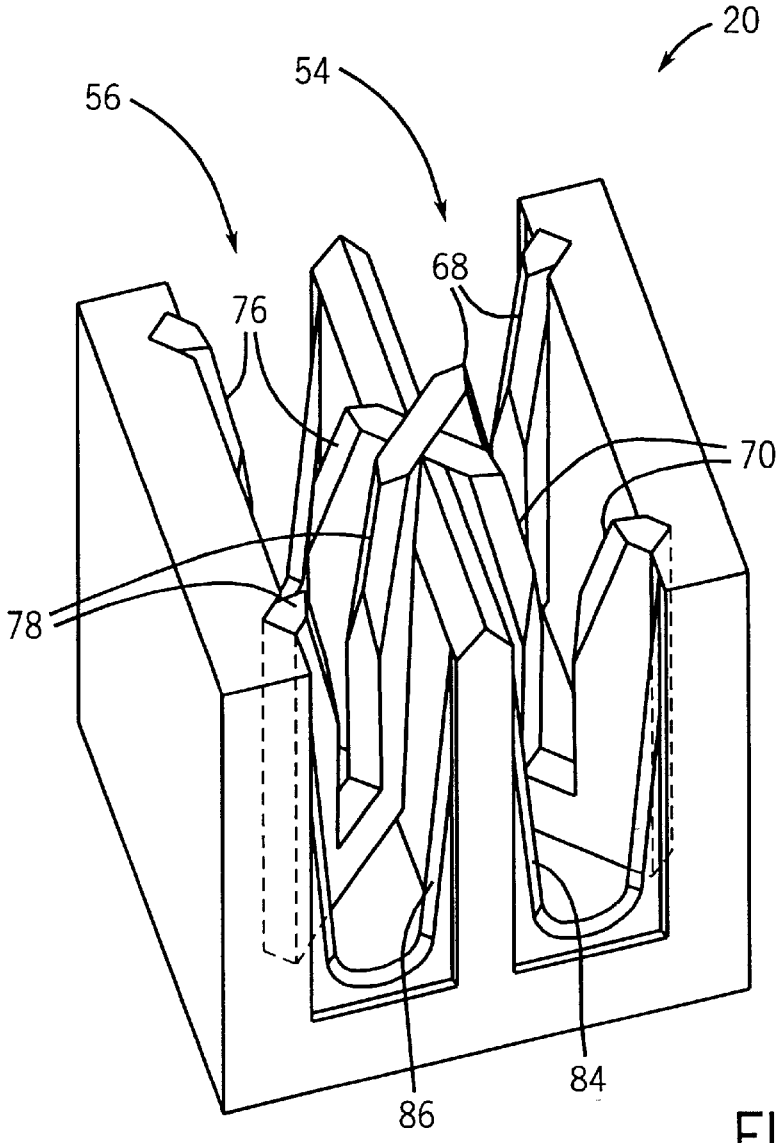
FIG. 3 is a perspective view of the electrical contactor.

The operation of the electrical contactor 20 is best illustrated with reference to FIGS. 1 through 3. FIG. 2 is a top view of the electrical contact section 12 illustrated in FIG. 1, while FIG. 3 is a perspective view of the electrical contactor 20. As discussed above, insulated wire assemblies may be inserted directly into the contactors 20 or they may be carried and supported by the electrical device 18. For illustrative purposes in FIG. 2, the insulated wire assemblies 42 and 44 are inserted into the receptacles 54 and 56 of the contactor 20 without the structure of the electrical device 18. In each of the receptacles 54 and 56, the contactor 20 includes a plurality of blades for cutting through insulation and electrically contacting the internal conductor.

The plurality of blades may be configured in any suitable configuration and orientation. For example, the contactor 20 has blade pairs 68 and 70 disposed in the receptacle 54 at angles 72 and 74, respectively, for piercing the insulation layer 46 and electrically contacting the conductor 50 of the insulated wire assembly 42. The contactor 20 also has blade pairs 76 and 78 disposed in the receptacle 56 at angles 80 and 82, respectively, for piercing the insulation layer 48 and electrically contacting the conductor 52 of the insulated wire assembly 44. The foregoing angles 72, 74, 80 and 82 may comprise any suitable angle for cutting through the insulation layers 46 and 48 and to provide a reliable electrical contact with the conductors 50 and 52. For example, the blade pairs 68, 70, 76 and 78 may be disposed at the same or different angles of 30°, 45°, 60°, 90° or any other oblique angle. Moreover, the blade pairs 68, 70, 76 and 78 may be disposed in parallel (i.e., the same angle), in a staggered orientation for contacting the insulated electrical wire assemblies in multiple longitudinal positions, in a converging configuration (e.g., inwardly toward one another or toward a common point), in a symmetrical or non-symmetrical orientation relative to the insulated wire assemblies 42 and 44, or any other suitable orientation between the respective blade pairs.

As illustrated in FIG. 3, the blade pairs 68, 70, 76 and 78 also have a generally wedge-shaped configuration to facilitate cutting through the insulation and securement of the wires within the contactor 20. For example, the wedge-shaped configuration may embody a V-shaped, U-shaped, or Y-shaped wire opening between the respective blade pairs. The blade pairs also may be disposed in sets along one or more shared planes, such as illustrated in FIG. 3. As illustrated, the blade pairs 68 and 78 and the blade pairs 70 and 76 share common planes and define W-shaped wire openings for the insulated wire assemblies 42 and 44, respectively. Moreover, The blade pairs 68, 70, 76 and 78 also may comprise any suitable material for piercing, electrically contacting, and retaining the respective wire assemblies. For example, the blade pairs 68–78 may embody a metallic structure, an insulative structure having one or more metallic blades, and insulative structure having one or more electrical contacts, or any other suitable configuration.

The contactor 20 also may have one or more retaining structures for securing the insulated wire assemblies 42 and 44 within the receptacles 54 and 56, respectively. For example, the contactor 20 has a pair of wedge shaped structures 84 disposed on opposite ends of the receptacle 54, while a pair of wedge shaped structures 86 are disposed on opposite ends of the receptacle 56. The foregoing wedge shaped structures 84 and 86 are configured to provide a compressive force on the insulation layers 46 and 48 to retain the insulated wire assemblies 42 and 44 within the receptacles 54 and 56, respectively. The wedge shaped structures 84 and 86 also may have a texture, a blade, or any other structure to provide a frictional force against the insulation layers.

Figure 4:
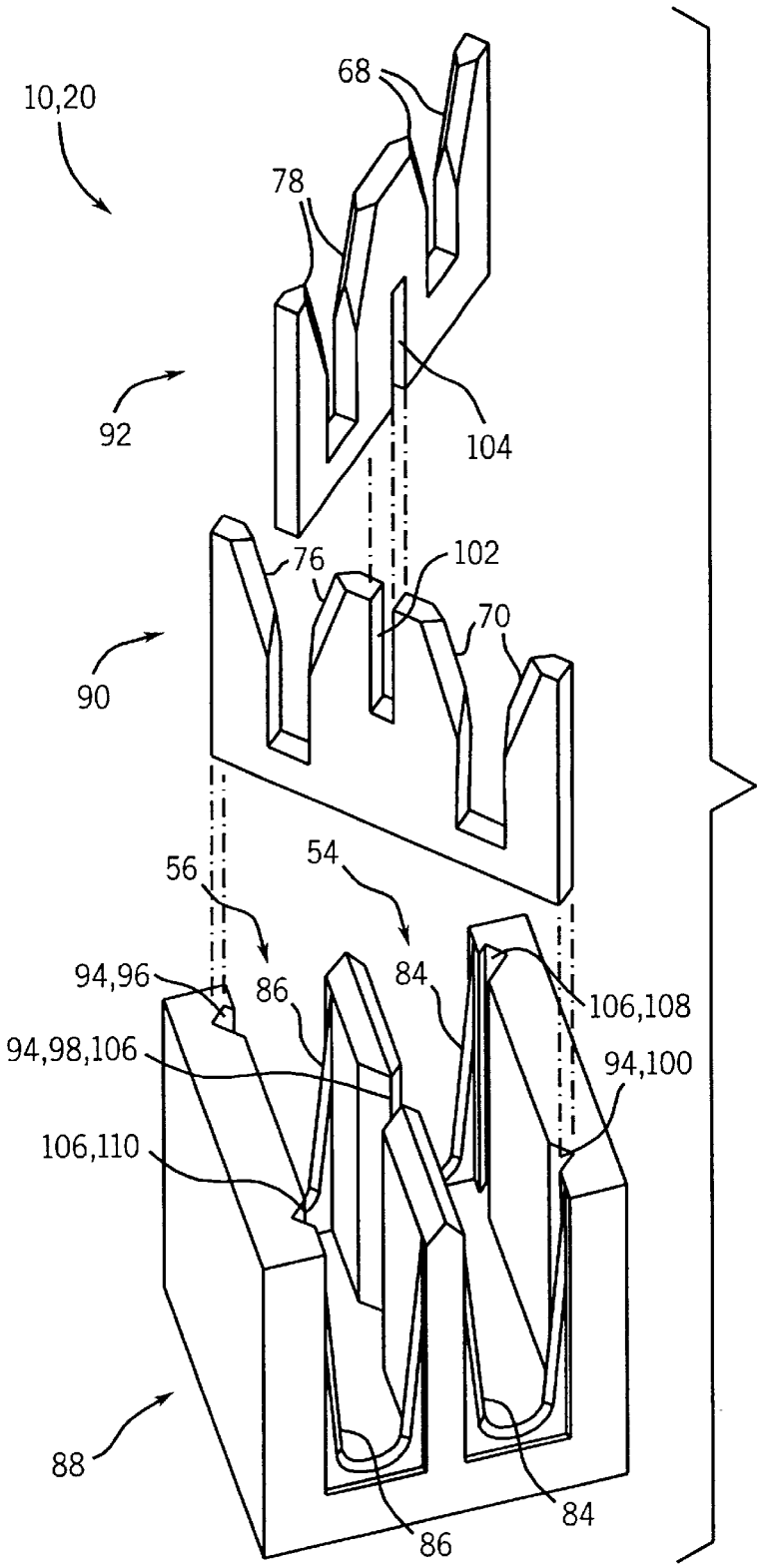
FIG. 4 is an exploded view of the electrical contactor.

The electrical contactor 20 may be formed from a variety of materials and components, including insulative and conductive materials, blade structures, retention structures, electrical housings, wiring and circuitry, and various other features. For example, the electrical contactor 20 may comprise an insulative housing 88 (e.g., an electrical housing) and insulation displacement assemblies 90 and 92, as illustrated by the exploded view of FIG. 4. In this exemplary embodiment, the insulation displacement assembly 90 is insertable into a slot 94, which extends through a side slot 96, a center slot 98, and a side slot 100 of the insulative housing 88. Either before or after insertion of the insulation displacement assembly 90 into the slot 94, the insulation displacement assemblies 90 and 92 may be coupled together via slots 102 and 104, respectively. The insulation displacement assembly 92 is also insertable into a slot 106, which extends through a side slot 108, the center slot 98, and a side slot 110 of the insulative housing 88.

In this exemplary embodiment, the insulation displacement assemblies 90 and 92 are disposed in an X-shaped or crisscross configuration, wherein the blade pairs 68, 70, 76 and 78 all converge at the center slot 98 of the insulative housing 88. In this X-shaped configuration, the insulation displacement assemblies 90 and 92 may be configured symmetrically or non-symmetrically. For example, the insulation displacement members 90 and 92 may be disposed perpendicular to one another and symmetrical relative to the receptacles 54 and 56. Alternatively, the insulation displacement assemblies 90 and 92 and the respective blade pairs may be disposed in parallel, in a staggered orientation in equal or different angles, or any other desired angular orientations. The electrical contactor 20 also may have a plurality of the insulation displacement assemblies 90 and 92 configured in the X-shaped configuration or any other desired orientation. As described above with reference to FIG. 3, the blade pairs 70 and 76 and the blade pairs 68 and 78 are each disposed on common planes via the insulation displacement assemblies 90 and 92, whereon the blade pairs form W-shaped receptacles for cutting through wire insulation, contacting the conductor, and retaining the both of the insulated wire assemblies 42 and 44. It also should be noted that each of the insulation displacement assemblies 90 and 92 may embody insulative structures having separate metallic/conductive blades for each of the blade pairs 70 and 76 and 68 and 78, respectively.

As described above, the electrical contact section 12 facilitates efficient electrical wiring for the electrical system 10. The present technique also facilitates efficient detachment of the electrical devices 14 and 18. Although insulated wire sets may be directly inserted into the receptacles 54 and 56 of the electrical contactor 20, the wire carrier section 16 facilitates efficient electrical wiring, removal, swapping and servicing of the electrical devices 14 and 18. For example, the wire carrier section 16 illustrated in FIG. 1 facilitates simultaneous coupling and uncoupling of four separate insulated wire sets, while the respective insulated wire sets are continually supported and retained by the wire carrier section 16. Accordingly, the electrical device 18 may be quickly uncoupled from the electrical device 14 and then recoupled to any other desired electrical device without rewiring the electrical device 18.

As mentioned above, the electrical devices 14 and 18 may embody any desired circuitry, switches, electronics and structures, which may be intercoupled via the foregoing sections 12 and 16. For example, in an exemplary embodiment of the system 10, the electrical device 14 may embody a coil or other energizable magnetic section, a contactor section disposed adjacent the coil, and circuitry to energize the coil and thereby magnetically move the contactor section to a desired electrical connection position. For example, the coil may cause prongs of the contactor section to close an electrical path between the insulated wire assembly 66 and one or more of the contactors 20 in the electrical contact section 12. If the electrical device 18 is coupled to the electrical device 14, then the foregoing magnetically induced closure may provide a desired connection between the insulated wire assemblies 42 and 44 and the insulated wire assembly 66.

Figure 5:
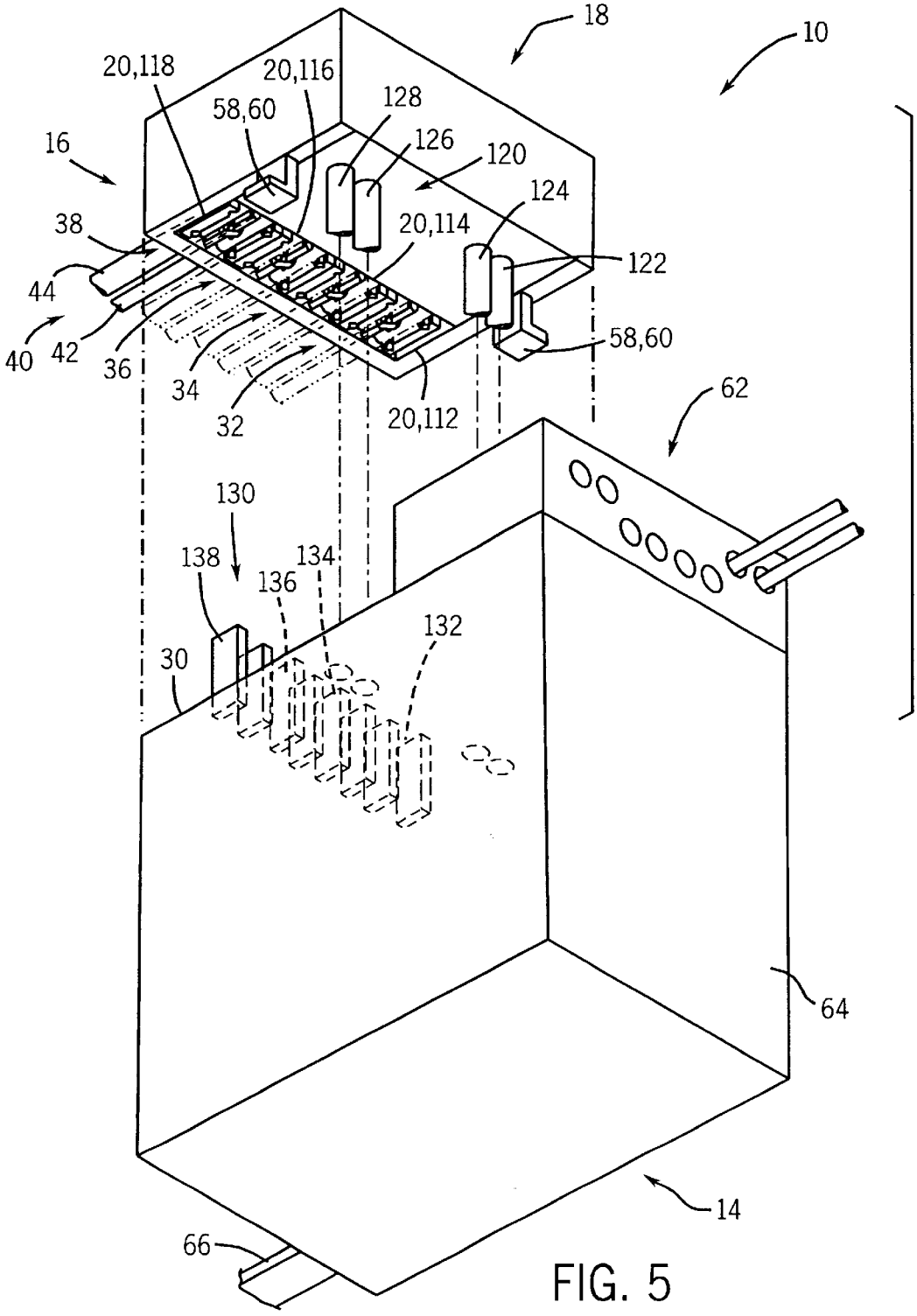
FIG. 5 is an exploded view of the wiring system illustrating an alternate configuration of the electrical contactor.

It also should be noted that the electrical contact and wire carrier sections 12 and 16 may be integrated into a single electrical device, such as the electrical devices 14 or 18, which may be configured for a mobile or stationary application. In this alternate configuration, an electrical plug may be provided for electrical coupling with another device. This electrical plug may have a snap-fit mechanism or any other suitable connection mechanism for fixedly or removably coupling the electrical devices. For example, an alternate embodiment of the electrical system 10 is illustrated in FIG. 5, wherein the electrical contact and wire carrier sections 12 and 16 are both disposed in the electrical device 18. In this exemplary embodiment, the electrical device 62 may have the electrical contact and wire carrier sections 12 and 16 disposed separately or integrally together in the electrical devices 14 and 62, respectively. Accordingly, one of the electrical devices 18 and 62 may be configured as illustrated in FIG. 1, while the other may be configured as illustrated in FIG. 5.

As illustrated, the electrical device 18 has the wire set 40 extending through the receptacle set 38 of the wire carrier section 16, which supports the insulated wire assemblies 42 and 44 for electrical coupling with the electrical contact section 12. In this exemplary embodiment, the electrical contact section 12 has contactors 20 disposed adjacent the receptacle sets 32, 34, 36 and 38 in positions 112, 114, 116 and 118 within the electrical device 18, respectively. The electrical device 18 also has an electrical coupling assembly 120 for electrically intercoupling the electrical devices 14 and 18. This electrical coupling assembly 120 may embody any suitable electrical connection mechanism, such as an electrical plug, rigid electrical contactors, insulated wire assemblies, or other such electrical connectors. As illustrated, the electrical coupling assembly 120 comprises electrical connectors 122, 124, 126 and 128, which are electrically coupled to the contactors 20 disposed in positions 112, 114, 116 and 118, respectively.

Accordingly, a desired electrical connection can be achieved by inserting an insulated wire set through a desired receptacle set in the wire carrier section 16, moving and inserting the insulated wire set into the contactor 20 disposed adjacent the desired receptacle set, and then interlocking the electrical device 18 and the corresponding electrical coupling assembly 120 with the electrical device 14 and a corresponding mating electrical coupling assembly. The electrical devices 14 and 18 are mechanically interlocked via the connector assembly 58, as described in FIG. 1. As the electrical devices 14 and 18 are interlocked, the insulated wire sets disposed in the respective receptacle sets 32, 34, 36 and 38 and contactors 20 of the electrical device 18 are secured or biased into the respective contactors (i.e., in positions 114, 116, 118 and 120) via a contact retention assembly 130, which is disposed in the electrical device 14. In this exemplary embodiment, the contact retention assembly comprises tab pairs 132, 134, 136 and 138, which are configured to bias the insulated wire assemblies into the receptacles 54 and 56 of the contactors 20 at positions 114, 116, 118 and 120, respectively. In operation, the insulated wire sets may simply be positioned over the respective contactors 20, and then, as the electrical devices 14 and 18 are interlocked, the respective tab pairs would bias the insulated wire sets into the contactors 20 to make an electrical connection. In either case, the integral arrangement of the electrical contact and wire carrier sections 12 and 16 in the electrical device 18 facilitates efficient device swapping, insertion and removal without repetitively rewiring the devices.

While the invention may be susceptible to various modifications and alternative forms, specific embodiments have been shown in the drawings and have been described in detail herein by way of example only. However, it should be understood that the invention is not intended to be limited to the particular forms disclosed. Rather, the invention is to cover all modifications, equivalents, and alternatives falling within the spirit and scope of the invention as defined by the following appended claims.

What is claimed is:

1. An electrical connector, comprising:

a first insulation displacement member disposed at a first angle; and a second insulation displacement member disposed at a second angle;

wherein the first and second insulation displacement members comprise conductive blades configured for slideably contacting a conductor disposed in an insulative material by a progressive wedging and cutting motion.

2. The electrical connector of claim 1, wherein the first and second insulation displacement members are staggered along a longitudinal axis for the conductor.

3. The electrical connector of claim 2, wherein the first and second angles are different oblique angles.

4. The electrical connector of claim 3, wherein the first and second insulation displacement members are angled inwardly toward one another.

5. The electrical connector of claim 2, wherein the conductive blades are disposed in a wedge-shaped configuration for receiving the conductor disposed in the insulative material.

6. The electrical connector of claim 5, comprising a retention structure for securing the conductor.

7. The electrical connector of claim 6, wherein the retention structure comprises a wedge-shaped receptacle configured to provide a compressive force on the insulative material.

8. The electrical connector of claim 1, wherein a plurality of first and second insulation displacement members are disposed in an electrical connector housing for electrical coupling with an insulated electrical wire assembly comprising a plurality of the conductor.

9. The electrical connector of claim 8, wherein the plurality of first insulation displacement members are position along a first plane at the first angle, and the plurality of second insulation displacement members are positioned along a second plane at the second angle.

10. An electrical connector, comprising:

a plurality of insulation piercing members disposed at a plurality of axial locations and angular positions relative to an axis, wherein the insulation piercing members have progressive sideways edges to cut sideways along and to pierce into an insulated conductor; and a conductive member disposed in each of the plurality of insulation displacement members.

11. The electrical connector of claim 10, wherein the plurality of insulation piercing members comprise wedge-shaped structures within the connector receptacle.

12. The electrical connector of claim 10, wherein the plurality of insulation piercing members comprise V-shaped structures within the connector receptacle.

13. The electrical connector of claim 10, wherein the plurality of insulation piercing members comprise W-shaped structures within the connector receptacle.

14. The electrical connector of claim 10, wherein the plurality of insulation piercing members comprise X-shaped structures within the connector receptacle.

15. The electrical connector of claim 10, wherein at least two of the angular positions are substantially symmetrical relative to the axis.

16. The electrical connector of claim 10, wherein at least two of the angular positions are substantially parallel relative to the axis.

17. The electrical connector of claim 10, wherein at least one of the angular positions has an oblique angular orientation relative to the axis.

18. The electrical connector of claim 10, wherein at least one of the conductive members comprises a cutting blade.

19. The electrical connector of claim 10, wherein at least one of the conductive members is coupled to an electrical connector lead.

20. The electrical connector of claim 10, wherein at least two of the conductive members are coupled together.

21. The electrical connector of claim 10, wherein at least two members of the plurality of insulation piercing members are disposed in staggered positions along the axis.

22. The electrical connector of claim 10, wherein the at least two members are disposed in different oblique angles relative to the axis.

23. An electrical connector, comprising:

a crosswise-receiving receptacle for an insulated conductor;

a plurality of insulation displacement structures fixedly extending into the crosswise-receiving receptacle at different longitudinal positions along the crosswise-receiving receptacle, wherein the insulation displacement structures comprise sideways and inward cutting edges.

24. The electrical connector of claim 23, wherein the crosswise-receiving receptacle has a lengthwise opening for a length of the insulated conductor.

25. The electrical connector of claim 23, comprising a plurality of the crosswise-receiving receptacle.

26. The electrical connector of claim 23, wherein the plurality of insulation displacement structures comprise conductive members.

27. The electrical connector of claim 26, wherein the conductive members comprise cutting structures.

28. The electrical connector of claim 26, wherein the conductive members comprise electrical connector leads.

29. The electrical connector of claim 23, wherein the plurality of insulation displacement structures comprise wedge-shaped structures.

30. The electrical connector of claim 23, wherein the plurality of insulation displacement structures comprise V-shaped structures.

31. The electrical connector of claim 23, wherein the plurality of insulation displacement structures comprise W-shaped structures.

32. The electrical connector of claim 23, wherein the plurality of insulation displacement structures comprise X-shaped structures.

33. The electrical connector of claim 23, wherein at least two of the plurality of insulation displacement structures are oriented in different angles relative to a longitudinal axis of the crosswise-receiving receptacle.

34. The electrical connector of claim 33, wherein the different angles comprise oblique angles relative to the longitudinal axis.

35. The electrical connector of claim 23, wherein at least two of the plurality of insulation displacement structures are oriented in substantially symmetrical angles relative to a longitudinal axis of the crosswise-receiving receptacle.

36. The electrical connector of claim 23, wherein at least two of the plurality of insulation displacement structures are oriented in substantially parallel angles relative to a longitudinal axis of the crosswise-receiving receptacle.

37. An electrical connector, comprising: receptacle means for receiving a length of an insulated conductor having an insulation layer surrounding an internal conductor; and multi-point contacting means disposed in the receptacle means for slideably cutting along and progressively piercing into the insulation layer and electrically contacting the internal conductor at multiple contact orientations.

38. The electrical connector of claim 37, comprising a plurality of the receptacle means having the multi-point contacting means.

39. The electrical connector of claim 37, comprising retaining means for securing the insulated conductor within the receptacle means.

40. The electrical connector of claim 37, wherein the multi-point contacting means are disposed in V-shaped configurations.

41. The electrical connector of claim 37, wherein the multi-point contacting means are disposed in W-shaped configurations.

42. The electrical connector of claim 37, wherein the multi-point contacting means are disposed in longitudinally-staggered positions relative to the receptacle means.

* * * * *